US008111252B2

(12) United States Patent
Nozawa

(10) Patent No.: US 8,111,252 B2
(45) Date of Patent: Feb. 7, 2012

(54) DETERMINING APPARATUS AND METHOD FOR CONTROLLING THE SAME

(75) Inventor: Ryoichi Nozawa, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 965 days.

(21) Appl. No.: 12/105,203

(22) Filed: Apr. 17, 2008

(65) Prior Publication Data

US 2008/0303807 A1 Dec. 11, 2008

(30) Foreign Application Priority Data

Apr. 19, 2007 (JP) ..... 2007-110454

(51) Int. Cl.
*G09G 5/00* (2006.01)

(52) U.S. Cl. ..... 345/207; 345/214

(58) Field of Classification Search ..... 345/7, 104, 345/207, 214; 348/14.07, 294
See application file for complete search history.

(56) References Cited

U.S. PATENT DOCUMENTS 5,130,543 A * 7/1992 Bradbeer ..... 250/342
5,936,596 A * 8/1999 Yoshida et al. ..... 345/9
6,504,649 B1 * 1/2003 Myers ..... 359/454
7,525,514 B2 * 4/2009 Ohno ..... 345/60
7,535,468 B2 * 5/2009 Uy ..... 345/207
7,762,676 B2 * 7/2010 Daly ..... 359/613
2007/0177006 A1 * 8/2007 De Zwart et al. ..... 348/51
2007/0229654 A1 * 10/2007 Kusuno ..... 348/51

FOREIGN PATENT DOCUMENTS

JP 06-230896 A 8/1994
JP 2005-284592 10/2005

* cited by examiner

*Primary Examiner* — Amare Mengistu
*Assistant Examiner* — Stacy Khoo
(74) *Attorney, Agent, or Firm* — Maschoff Gilmore & Israelsen

(57) ABSTRACT

There is provided a method for controlling a determining apparatus including: a first pixel for displaying a first image; a second pixel for displaying a second image; a light shielding member that allows the first image to be viewed from a first direction and blocks the first image from a second direction, and allows the second image to be viewed from the second direction and blocks the second image from the first direction; a first sensor provided for the first pixel and detecting the quantity of light coming from the first direction; and a second sensor provided for the second pixel and detecting the quantity of light coming from the second direction. The method includes: storing at least one frame of the results of detection of the first and second sensors; and after obtaining the present results of detection of the first and second sensors, determining whether an object approaches from the first direction or the second direction from the result of comparison between the stored detection results of one frame and the results of detection of present one frame.

9 Claims, 15 Drawing Sheets

< DRIVER SEAT >
< PASSENGER SEAT >
100
150
110
(a)
(b)
(c)
L R L R L R

< PASSENGER SEAT >
< DRIVER SEAT >
100
150
110
(a)
(b)
L R L R L R

DETERMINING APPARATUS AND METHOD FOR CONTROLLING THE SAME

BACKGROUND

1. Technical Field

The present invention relates to a technique for discriminating between operations from different directions on a display screen.

2. Related Art

Display panels having a so-called dual image display mode have recently become popular in which different images can be viewed from two directions. To provide an information input capability to such display panels having a two-screen display mode, it is necessary to discriminate between input operations, because the input operations are made from two directions.

There is therefore proposed a technique for determining the direction of the viewer by displaying icons corresponding to two screens so as not to agree with each other and by detecting an operated icon (for example, refer to JP-A-2005-284592).

However, in the above-described technique, the direction of operation is determined from the position of the icon touched. Accordingly, the proximity of icons corresponding to two screens may cause misidentification. To prevent it, it is necessary for the above technique to display the two icons in different positions as far as possible, thus resulting in limitations to the display screen.

SUMMARY

An advantage of some aspects of the invention is that a determining apparatus capable of direct determination of the direction of input operation and a method for controlling the same are provided.

According to a first aspect of the invention, there is provided a method for controlling a determining apparatus including: first pixels for displaying a first image; second pixels for displaying a second image; a light shielding member that allows the first image to be viewed from a first direction and blocks the first image from a second direction, and allows the second image to be viewed from the second direction and blocks the second image from the first direction; a first sensor provided for at least one of the first pixels and detecting the quantity of light coming from the first direction; and a second sensor provided for at least one of the second pixels and detecting the quantity of light coming from the second direction. The method includes: obtaining a first detection result of the first sensor and a second detection result of the second sensor during a first time; obtaining a third detection result of the first sensor and a fourth detection result of the second sensor during a second time after the first time; obtaining a first result by comparing the third detection result with the first detection result; obtaining a second result by comparing the fourth detection result with the second detection result; and determining whether an object is approaching from the first direction or from the second direction based on the first result and the second result. This invention allows direct determination of whether an object approaches from the first direction or the second direction from the results of detection by the first and second sensors.

It is preferable that, in the step of obtaining the first result, determining a shrinkage ratio in quantity of light detected by the first sensor between the first detection result and the third detection result, in the step of obtaining the second result, determining a shrinkage ratio in quantity of light detected by the second sensor between the second detection result and the fourth detection result, and in the step of determining, comparing the first result and the second result to determine whether a shrinkage ratio is greater for the first sensor or for the second sensor, determining that an object is approaching from the first direction when the shrinkage ratio is greater for the first sensor than for the second sensor, and determining that an object is approaching from the second direction when the shrinkage ratio is greater for the second sensor than for the first sensor.

It is preferable that, in the step of obtaining the first result, determining a shift amount of gravity center in quantity of light detected by the first sensor between the first detection result and the third detection result, in the step of obtaining the second result, determining a shift amount of gravity center in quantity of light detected by the second sensor between the second detection result and the fourth detection result, and in the step of determining, comparing the first result and the second result to determine whether a shift amount of gravity center is greater for the first sensor or for the second sensor, determining that an object is approaching from the first direction when the shift amount is smaller for the first sensor than for the second sensor, and determining that an object is approaching from the second direction when the shift amount is smaller for the second sensor than for the first sensor.

It is preferable that, in the step of determining by comparing the first result and the second result, determining that an object is approaching from the center between the first direction and the second direction when the shift in quantity of light detected by the first sensor between the first detection result and the third detection result being symmetrical to the shift in quantity of light detected by the second sensor between the second detection result and the fourth detection result.

It is preferable that the first image and/or the second image be controlled according to an approaching direction determined. According to a second aspect of the invention, there is provided a method for controlling a determining apparatus including: first pixels for displaying a first image; second pixels for displaying a second image; a light shielding member that allows the first image to be viewed from a first direction and blocks the first image from a second direction, and allows the second image to be viewed from the second direction and blocks the second image from the first direction; first sensors provided for the first pixels, the first sensors being detecting the quantity of light coming from the first direction and including a third sensor that is provided adjacent to the first direction and a fourth sensor that is provided adjacent to the second direction; and second sensors provided for the second pixels, the second sensors being detecting the quantity of light coming from the second direction and including a fifth sensor that is provided adjacent to the first direction and a sixth sensor that is provided adjacent to the second direction. The first and second sensors being arranged in a matrix matter. The method includes: obtaining a first detection result of the fourth sensor and a second detection result of the fifth sensor during a first time; obtaining a third detection result of the fourth sensor and a fourth detection result of the fifth sensor during a second time after the first time; and in the case that there is a difference between the second detection result and the fourth detection result, determining that an object is approaching from the first direction, and in the case that there is a difference between the first detection result and the third detection result, determining that an object is approaching from the second direction.

It is preferable that, in the case that there is a difference between the second detection result and the fourth detection result, detecting the quantity of light by using the first sensors, and in the case that there is a difference between the first detection result and the third detection result, detecting the quantity of light by using the second sensors.

According to a third aspect of the invention, there is provided a method for controlling a determining apparatus including: first pixels for displaying a first image; second pixels for displaying a second image; a light shielding member that allows the first image to be viewed from a first direction and blocks the first image from a second direction, and allows the second image to be viewed from the second direction and blocks the second image from the first direction; a first sensor provided for the first pixel and detecting the quantity of light coming from the first direction; and a second sensor provided for the second pixel and detecting the quantity of light coming from the second direction. The method includes: storing at least one frame of the results of detection of the first and second sensors; and after obtaining the present results of detection of the first and second sensors, determining whether an object approaches from the first direction or the second direction from the result of comparison between the stored detection results of one frame and the results of detection of present one frame. This invention allows direct determination of whether an object approaches from the first direction or the second direction from the results of detection by the first and second sensors.

It is preferable that, for each of the results of detection by the first sensor and the second sensor, one frame of the stored results and one frame of the present results be compared to determine that an object approaches from the direction corresponding to the detection results in which the area of the light-quantity changed portion is smaller. It is preferable that, for each of the results of detection by the first sensor and the second sensor, one frame of the stored results and one frame of the present results be compared to determine that an object approaches from the direction corresponding to the detection results in which the shift of the center of gravity of the light-quantity changed portion is smaller.

It is preferable that, in the first and second matrix sensors, when one of the outermost two sides adjacent to the first direction and the outermost two sides adjacent to the second direction has changed in the quantity of light, it be determined that an object approaches from the other of the first and second directions.

It is preferable that, in the first and second matrix sensors, the quantity of light be detected by the outermost two sides adjacent to the first direction and the outermost two sides adjacent to the second direction; when the pixels on one of the sides adjacent to the first and second directions have changed in the quantity of light, it be determined that an object approaches from the other of the first and second directions; and thereafter the quantity of light be determined by one of the first and second sensors.

It is preferable that, for each of the results of detection by the first sensor and the results of detection by the second sensor, one frame of the stored results and one frame of the present results be compared, wherein when the light-quantity changed portions are in symmetry, it be determined that an object approaches from the center.

It is preferable that a first image and/or a second image be controlled according to an approaching direction determined.

The invention can be applied not only to a method for controlling a determining apparatus but also to a determining apparatus capable of display.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described with reference to the drawings.

First Embodiment

A display device according to a first embodiment of the invention will first be described. The display device is, for example, the display of a car navigation system, which is located in the center of the dashboard of a vehicle and capable of displaying different images for the driver seat and the passenger seat.

In this description, the driver seat is on the right (the passenger seat is on the left) in the direction of travel of the vehicle, with right-hand drive cars as the reference. Conversely, as viewed from the direction of the display, the driver seat is on the left (the passenger seat is on the right).

Figure 1:
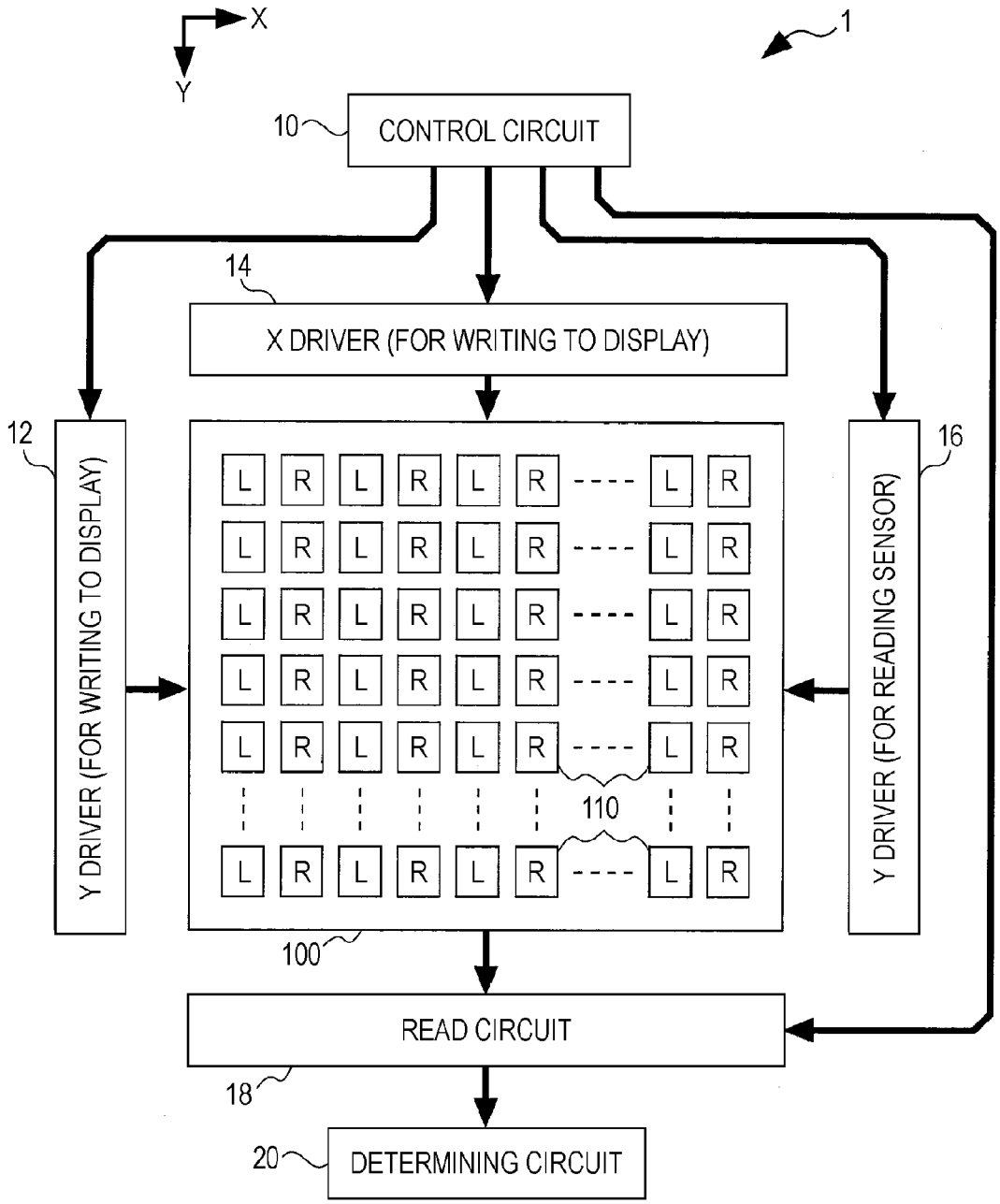
FIG. 1 is a diagram showing the structure of a display device according to a first embodiment of the invention.

FIG. 1 shows the structure of the display device 1. Of the components of car navigation systems, components other than those for display and input are omitted here because they have no direct relation to the invention.

As shown in FIG. 1, the display device 1 includes a control circuit 10, a Y driver 12, an X driver 14, a Y driver 16, a read circuit 18, a determining circuit 20, and a display panel 100. Among them, the display panel 100 of this embodiment has a matrix array in which pixels L for displaying an image to be viewed from the driver seat and pixels R for displaying an image to be viewed from the passenger seat are disposed alternately in a striped pattern.

There is no difference in structure between the pixels L and the pixels R; a mere difference is the sources of images to be displayed by those pixels. They are therefore simply referred to as pixels 110 if there is no need to discriminate between them.

Figure 2:
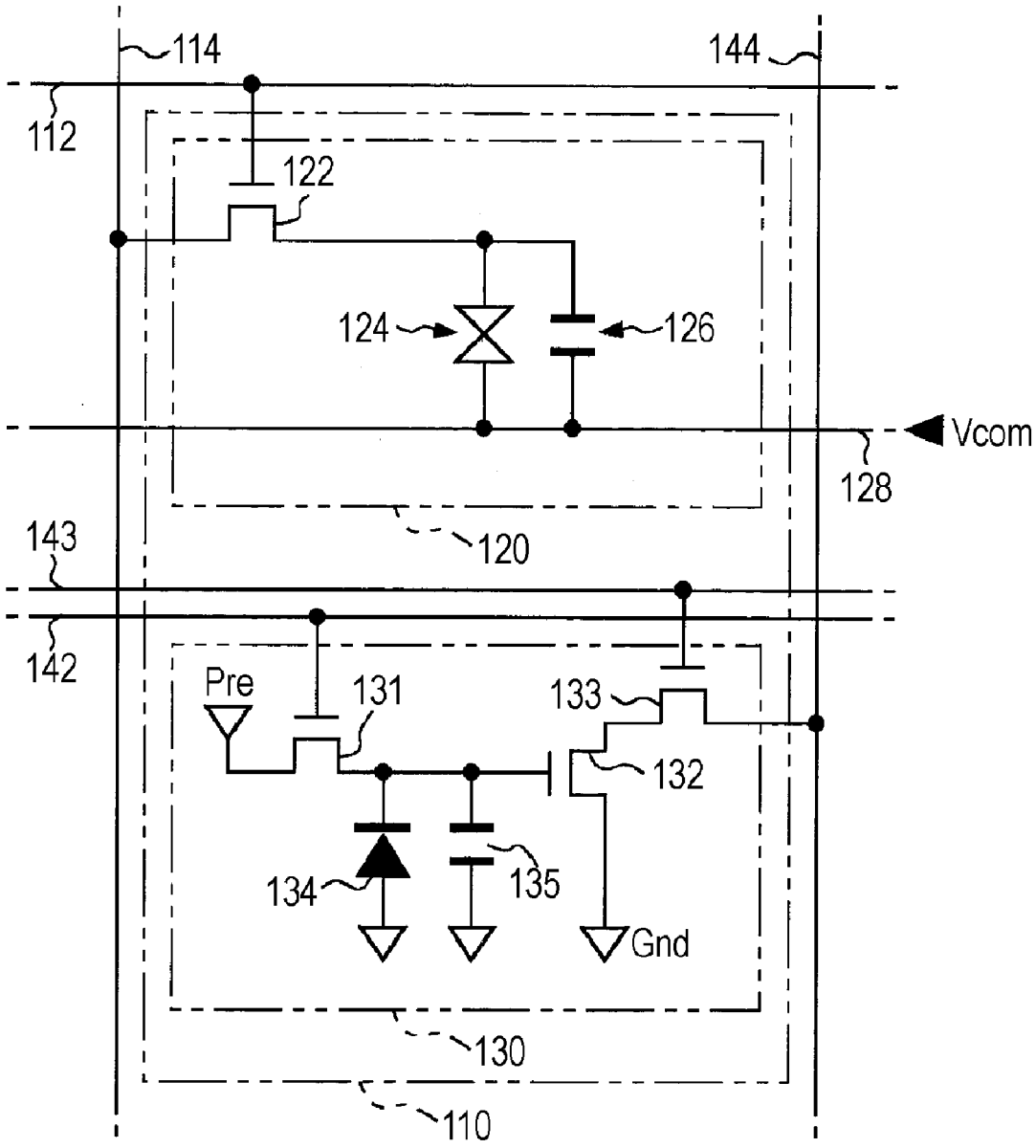
FIG. 2 is a diagram of one example of the pixels of the display device.

Referring now to FIG. 2, the pixels 110 will be described.

While the pixels 110 are actually arrayed in matrix form as shown in FIG. 1, FIG. 2 shows any one of the pixels arrayed in matrix form.

One scanning line 112 extending in the X direction is shaped by one row of the matrix of pixels 110, and one data line 114 extending in the Y direction is shared by one column of the pixels 110. Similarly, control lines 142 and 143 extending in the X direction are shared by one row of the pixels 110, and one read line 144 extending in the Y direction is shared by one column of the pixels 110.

As shown in FIG. 2, the pixels 110 are each divided into two, a display system 120 and a sensor system 130.

The display system 120 includes an n-channel transistor 122, a liquid crystal element 124, and a storage capacitor 126. The gate electrode of the transistor 122 connects to the scanning line 112; the source electrode connects to the data line 114; and the drain electrode connects in common to a first end of the liquid crystal element 124 and a first end of the storage capacitor 126. A second end of the liquid crystal element 124 connects to a common electrode 128 which is held at a voltage Vcom and connected in common to the pixels 110.

In this embodiment, a second end of the storage capacitor 126 is also connected electrically in common to the common electrode 128, because it is held at the voltage Vcom.

As is known, the liquid crystal element 124 has a structure in which liquid crystal is sandwiched between a pixel electrode connected to the drain electrode of the transistor 122 and the common electrode 128 common to the pixels 110, so it has a transmittance corresponding to the effective value of the voltage held by the pixel electrode and the common electrode 128.

When the voltage of the scanning line 112 reaches a high level higher than a threshold, the transistor 122 is turned on, so that a voltage provided to the data line 114 is applied to the pixel electrode. Therefore, if the voltage of the data line 114 is brought to a voltage corresponding to the gray level when the scanning line 112 rises to a high level, the difference voltage between the voltage corresponding to the gray level and the voltage Vcom is written to the liquid crystal element 124. When the scanning line 112 falls to a low level, the transistor 122 is turned off. However, the difference voltage written to the liquid crystal element 124 is held by the voltage holding performance of the liquid crystal element 124 and the storage capacitor 126 connected in parallel thereto, so that the liquid crystal element 124 is given a transmittance corresponding to the held difference voltage.

The sensor system 130 includes transistors 131, 132, and 133, a PIN photodiode 134, and a sensor capacitor 135. The transistor 131 is for precharging the sensor capacitor 135 with voltage, of which the gate electrode connects to the control line 142, the source electrode connects to a feed line for feeding a voltage Pre, and the drain electrode connects to the anode of the photodiode 134, a first end of the sensor capacitor 135, and the gate electrode of the transistor 132. The photodiode 134 and the sensor capacitor 135 are connected in parallel between the drain electrode of the transistor 131 (the gate electrode of the transistor 132) and the ground potential Gnd at a reference level. The source electrode of the transistor 132 is grounded to the potential Gnd, and the drain electrode is connected to the source electrode of the reading transistor 133. The gate electrode of the transistor 133 connects to the control line 143, and the drain electrode connects to the read line 144.

In the sensor systems 130, when the control line 142 rises to a high level, the transistor 131 is turned on, so that the sensor capacitor 135 is precharged with the voltage Pre. When the control line 142 falls to a low level, so that the transistor 131 is turned off, a reverse-biased leak current flows through the photodiode 134 as incident light increases, so that the voltage held in the sensor capacitor 135 decreases from the voltage Pre. Specifically, the voltage of a first end of the sensor capacitor 135 substantially is held at the voltage Pre if the leak current of the photodiode 134 is low, and comes close to zero as the leak current increases.

When the voltage of the control line 143 is raised to a high level after the read line 144 is precharged with a predetermined voltage, the transistor 133 is turned on, so that the drain electrode of the transistor 132 is connected to the read line 144. If the quantity of light incident on the photodiode 134 is small, so that the first end of the sensor capacitor 135 is held substantially at the voltage Pre, the transistor 133 is turned on, so that the voltage of the read line 144 sharply changes from the precharge voltage to zero. On the other hand, if the quantity of light incident on the photodiode 134 is large, so that the voltage of the first end of the sensor capacitor 135 drops to zero because of leak current, the transistor 133 is turned off, so that the voltage of the read line 144 changes little from the precharge voltage.

In this way, it can be determined whether the quantity of light incident on the pixel 110 at the intersection of the control line 142 (143) and the read line 144 is large or small according to whether the read line 144 changes from the precharge voltage when the voltage of the control line 142 is decreased from a high level to a low level and then the voltage of the control line 143 is raised to a high level.

Although the scanning line 112 and the control lines 142 and 143 of FIG. 2 are different lines, part of them may be shared. Likewise, although the data line 114, the read line 144, and the voltage-Pre feed line are different lines, part of them may be shared.

Although one pixel 110 has a set of the display system 120 and the sensor system 130, the sensor system 130 may be shared by two or more pixels 110.

Referring back to FIG. 1, the control circuit 10 controls the Y driver 12, the X driver 14, the Y driver 16, and the read circuit 18.

The Y driver 12 selects one from the scanning lines 112 on the display panel 100 in sequence under the control of the control circuit 10, and raises the elected scanning line 112 to a high level, with the other scanning lines 112 held at a low level. The X driver 14 applies a voltage corresponding to the gray level of the pixels 110 at the selected scanning line 112 to the data line 114.

The X driver 14 receives an image signal from a higher-level control circuit (not shown), converts it to a voltage suitable for display, and provides it to the data line 114. For a two-screen display mode, the X driver 14 receives two kinds of image signal.

The Y driver 16 executes the operation of lowering the voltage of the control line 142 on the display panel 100 from a high level to a low level, and then raising the voltage of the paired control line 143 to a high level in sequence from one row to another of the pixels 110 under the control of the control circuit 10.

The read circuit 18 serving also as a detection circuit reads the voltages of the precharged read lines 144 of every column, and then determines whether the read voltages have changed from the precharge voltages. Specifically, if the voltage of the read line 144 has changed from the precharge voltage to zero, the read circuit 18 determines that the quantity of light incident on the sensor system 130 of the pixel defined by the column of the read line 144 and the row controlled by the Y driver 16 is large; in contrast, if the voltage of the read line 144 has not changed from the precharge voltage, the read circuit 18 determines that the quantity of light incident on the sensor system 130 of the pixel defined by the column of the read line 144 and the row controlled is small.

Thus, by selecting one of the scanning lines 112 in sequence and applying a voltage corresponding to the gray level of the pixel at the selected scanning line 112 to the data line 114, the liquid crystal element 124 of the display system 120 can hold the voltage corresponding to the gray level.

Likewise, by controlling the control lines 142 and 143 one by one and determining changes in the voltages of the read lines 144 every control, the quantity of light incident on the sensor systems 130 can be determined for all the pixels.

The time required to control the control lines 142 and 143 from the first to the last rows is referred to as a sensor frame period. In this embodiment, the sensor frame period has no relation to a vertical scanning period required for image display, because the scanning line 112 and the control lines 142 and 143 are independent.

The determining circuit 20 stores the results of determination by the sensor systems 130 of all the pixels for several frame periods, from which it determines the operation on the display panel 100 according to the procedure described later.

Figure 3:
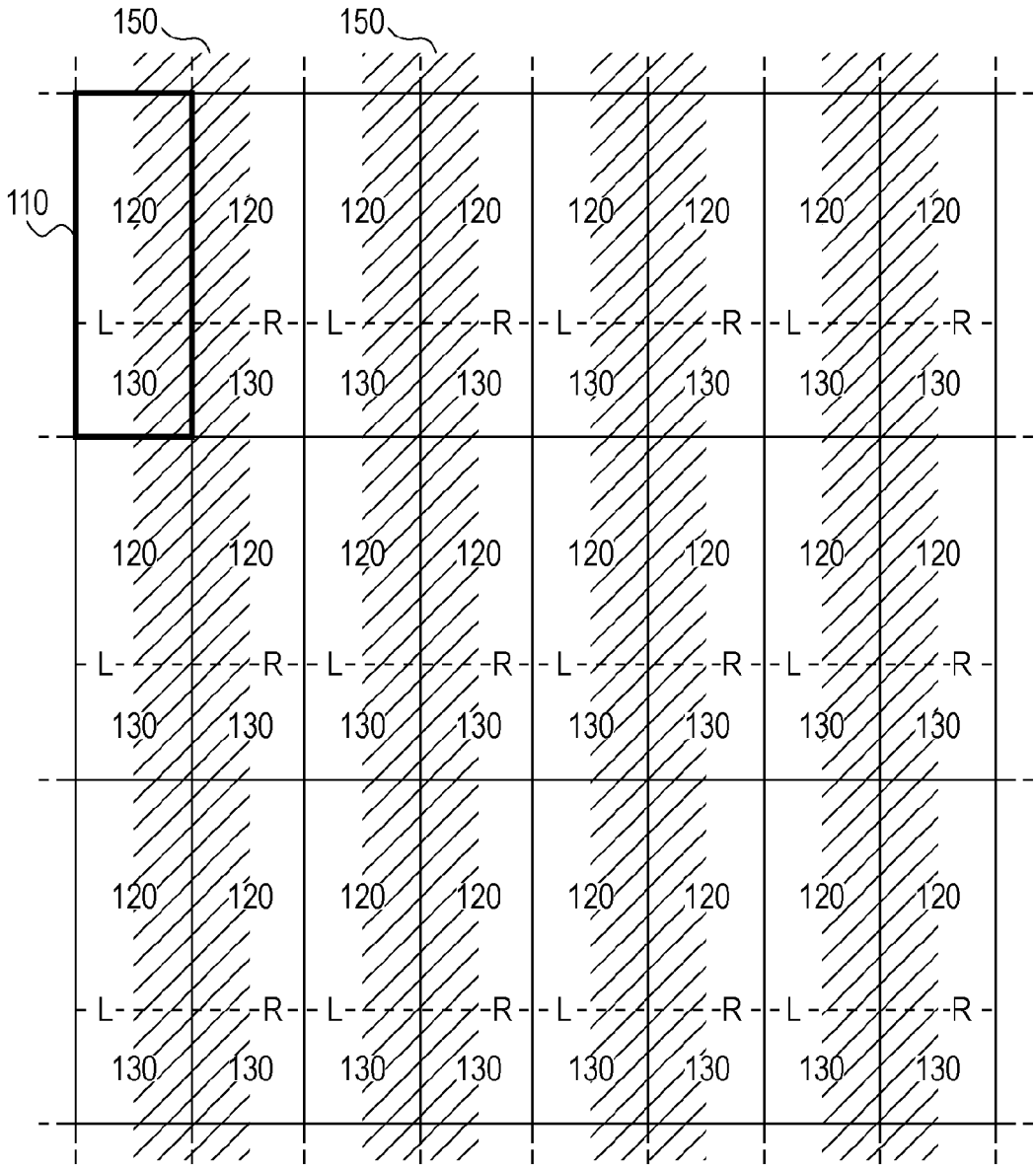
FIG. 3 is a diagram showing the relationship between the pixels and the optical members of the display device.

FIG. 3 is a plan view of light-shielding members (image splitters) 150 of the display panel 100 for the matrix pixels 110, as viewed from the back (from the side opposite to the viewing direction). In this drawing, the driver seat is on the left and the passenger seat is on the right, because it is viewed from the back.

As shown in FIGS. 1 and 3, the pixels L and the pixels R are arrayed continuously in the vertical direction and alternately in the horizontal direction in a matrix form. As shown in FIG. 3, the light-shielding members 150 are each shaped like a belt, which are disposed closer to the viewer than to the liquid crystal element 124 in such a manner that their centers agree with the boundary between the pixels L and the pixels R. The light-shielding members 150 allows the pixels L to open to the driver seat and to be blocked from the light from the passenger seat, and in contrast, allows the pixels R to open to the passenger seat and to be blocked from the light from the driver seat.

That is, the light-shielding members 150 common to the display system 120 and the sensor system 130 are provided for each of the pixels L and the pixels R. For the pixels L, for example, the openings of the light-shielding members 150 for the display systems 120 are disposed at the same angle as those of the light-shielding members 150 for the sensor systems 130.

Figure 4:
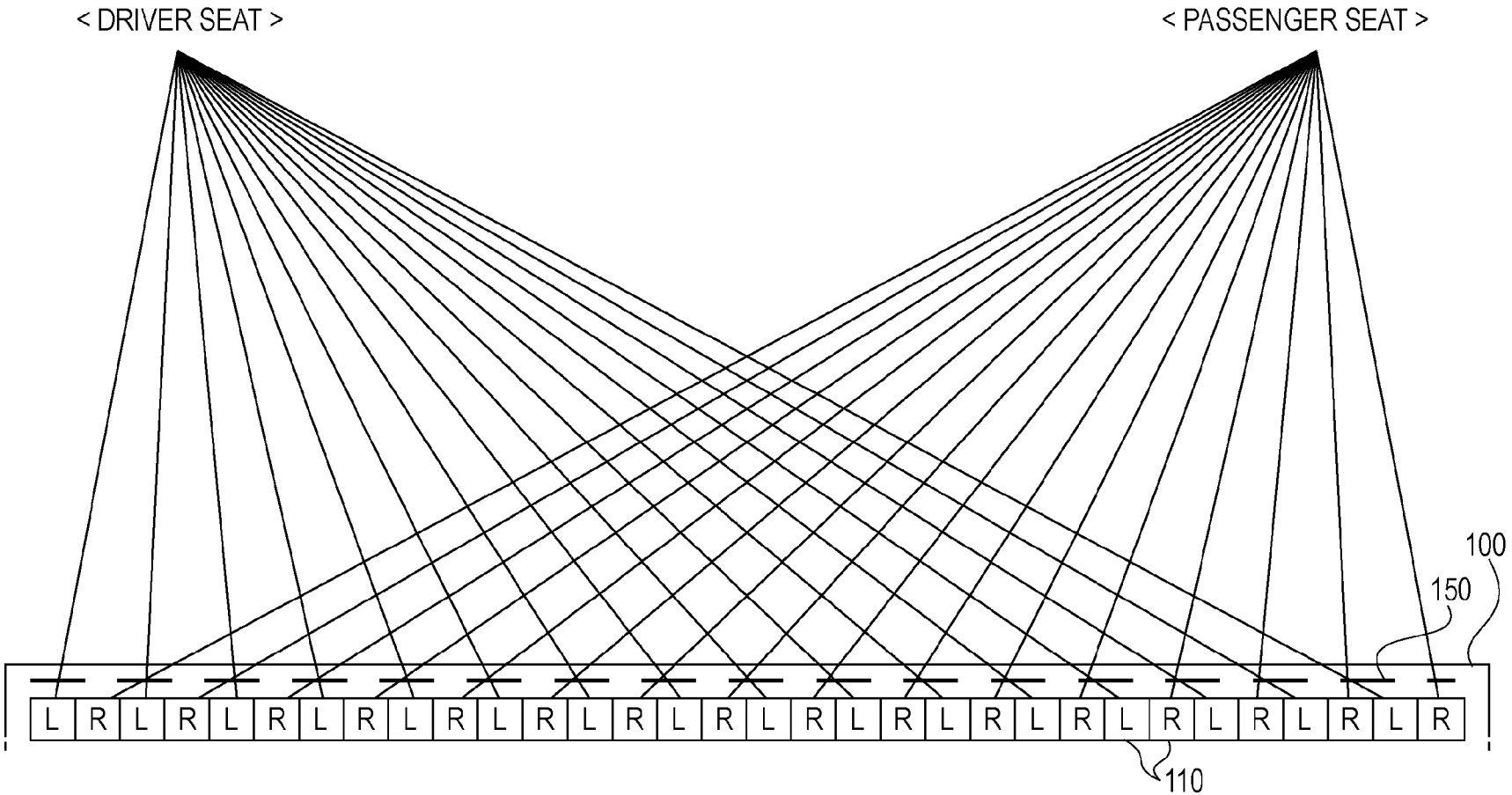
FIG. 4 is a diagram showing the optical paths of the display device.

Accordingly, as shown in FIG. 4, the display systems 120 of the pixels L are viewed from the driver seat, but the pixels R are blocked; in contrast, the display systems 120 of pixels R are viewed from the passenger seat, but the pixels L are blocked, thus allowing different images to be displayed on the driver seat side and the passenger seat side (two-screen display mode).

Also in the sensor systems 130, the sensor systems 130 of the pixels L are shielded from light from the passenger seat, and the sensor systems 130 of the pixels R are shielded from light from the driver seat.

Assuming a driver or passenger seat position, images from the pixels L are concentrated to the driver seat, and images from the pixels R are concentrated to the passenger seat. To this end, the pitches of the pixels L and the pixels R are set slightly larger than that of the openings of the light-shielding members 150. Referring to FIG. 4, the widths of the light-shielding portions of the light-shielding members 150 increase from the center of the display panel 100 to both ends.

FIG. 4 shows a simplified arrangement of the light-shielding members 150 for describing the optical paths to the driver seat and the passenger seat. The actual optical paths are shown in FIG. 3.

Figure 15:
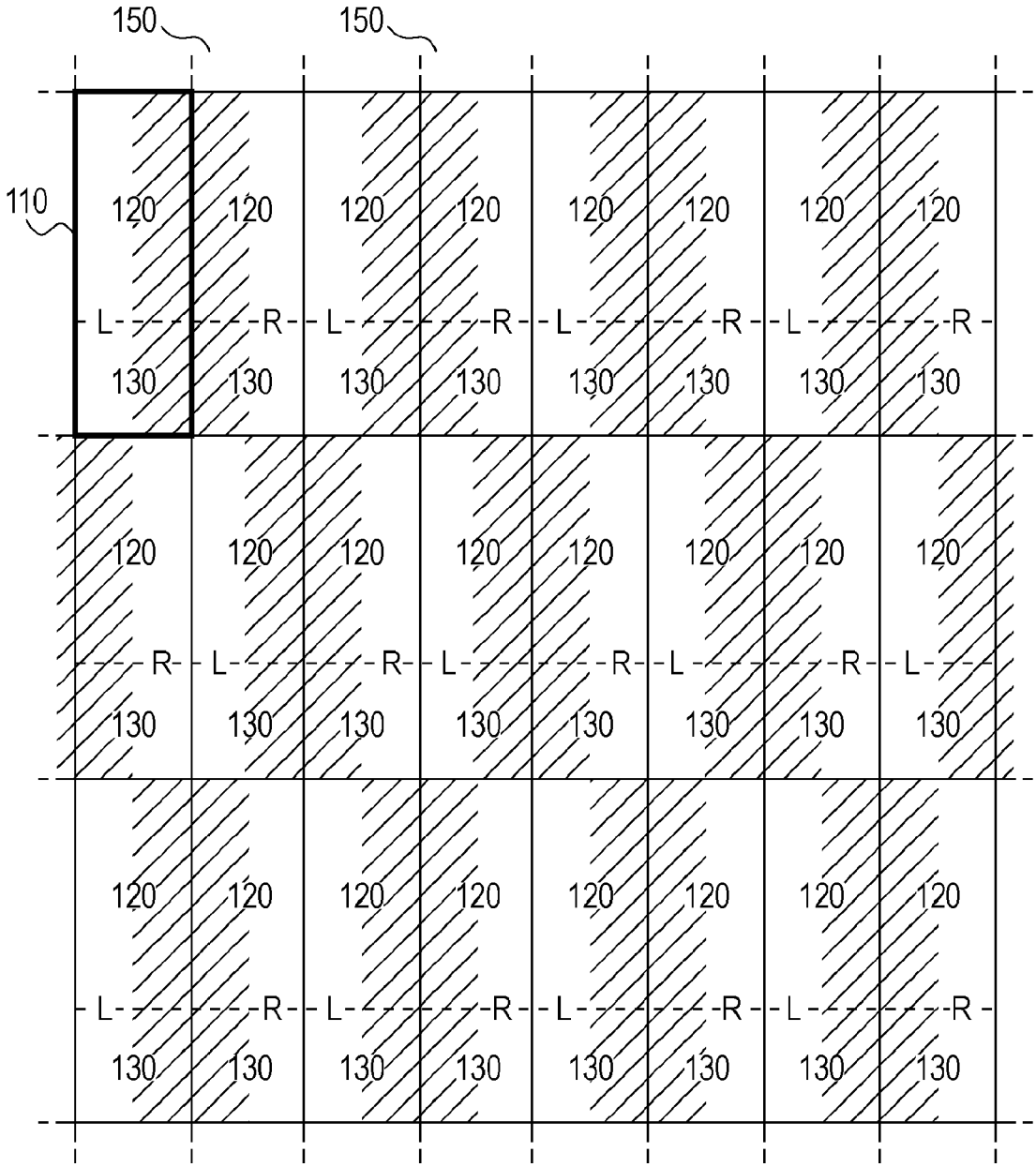
FIG. 15 is a diagram showing another relationship between the pixels and the optical members of the display device.

The arrangement of the light-shielding members 150 for the array of pixels L and pixels R may be that shown in FIG. 15, in addition to that shown in FIG. 3. That is, the pixels L and the pixels R may be arrayed alternately row by row, to which the arrangement of the light-shielding members 150 may be changed. This pixel array can improve the resolution of display.

The arrangement shown in FIG. 15 also allows the sensor systems 130 of pixels L to be blocked from light from the passenger seat and the sensor systems 130 of pixels R to be blocked from light from the drive seat.

Figure 6:
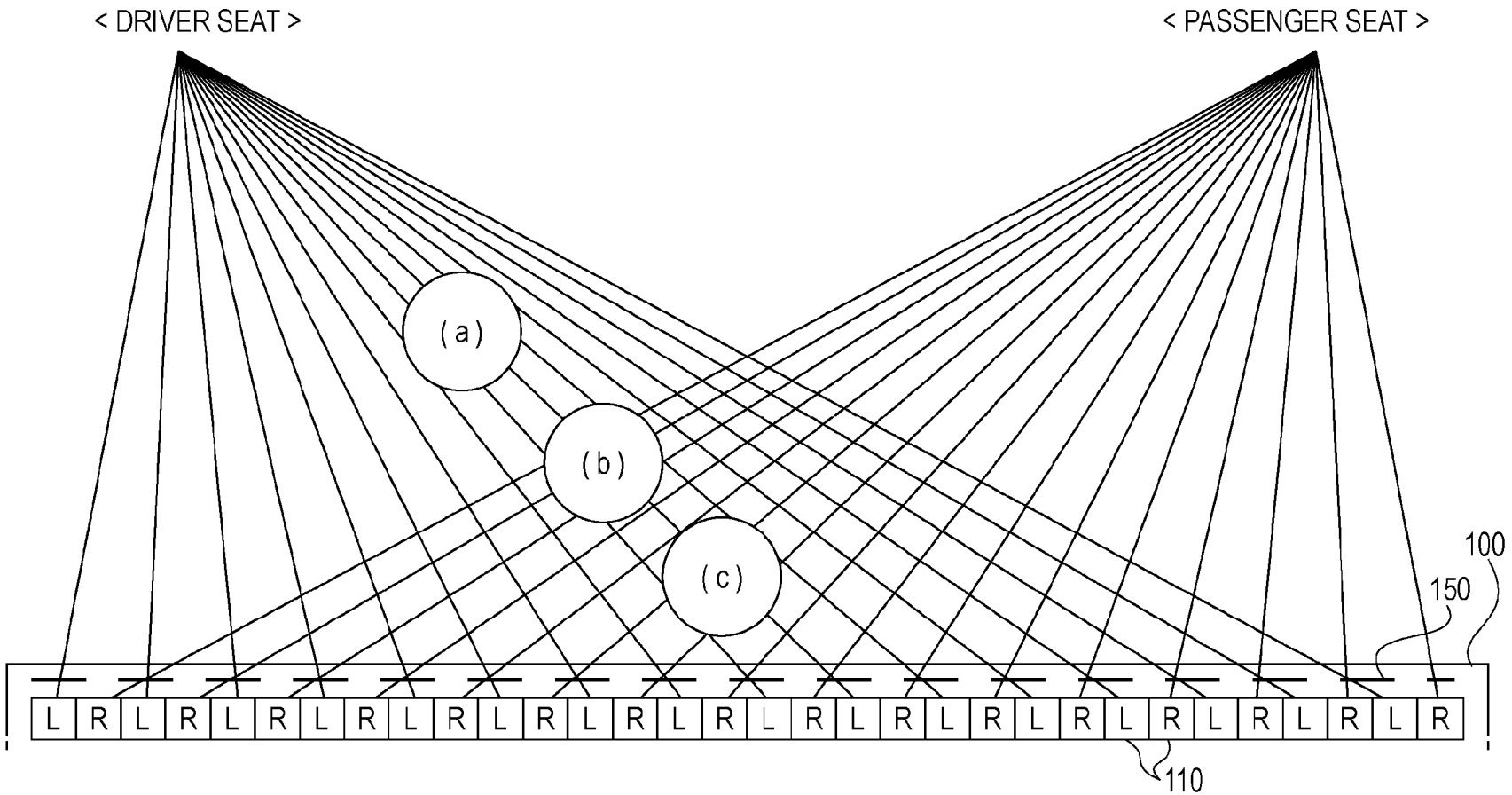
FIG. 6 is a diagram showing the process for determination of operation on the display device.
Figure 7A:
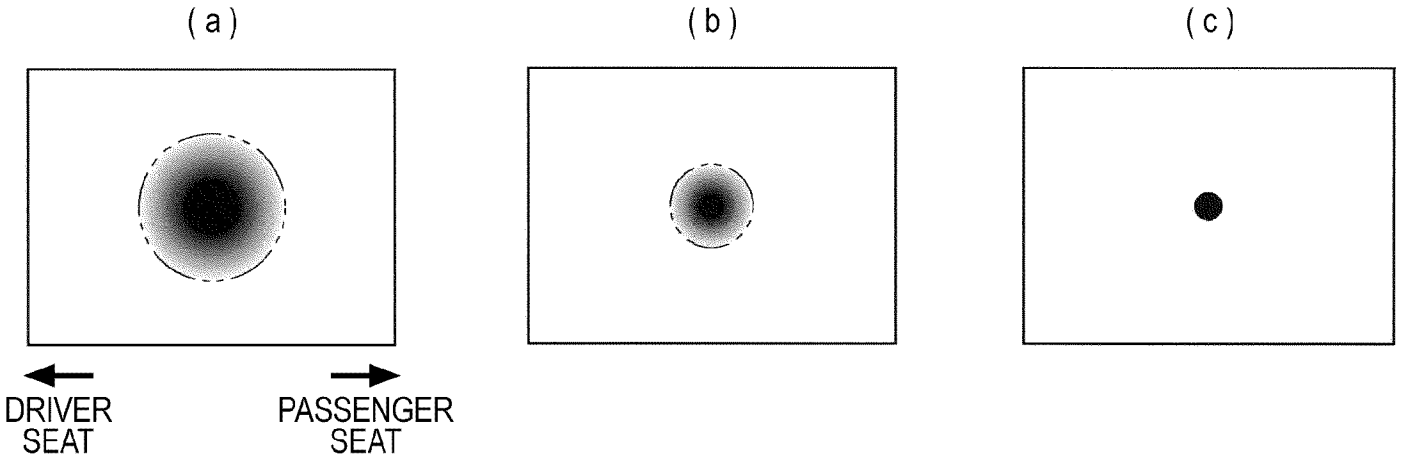
FIG. 7A is a diagram showing the process for determination of operation on the display device.
Figure 7B:
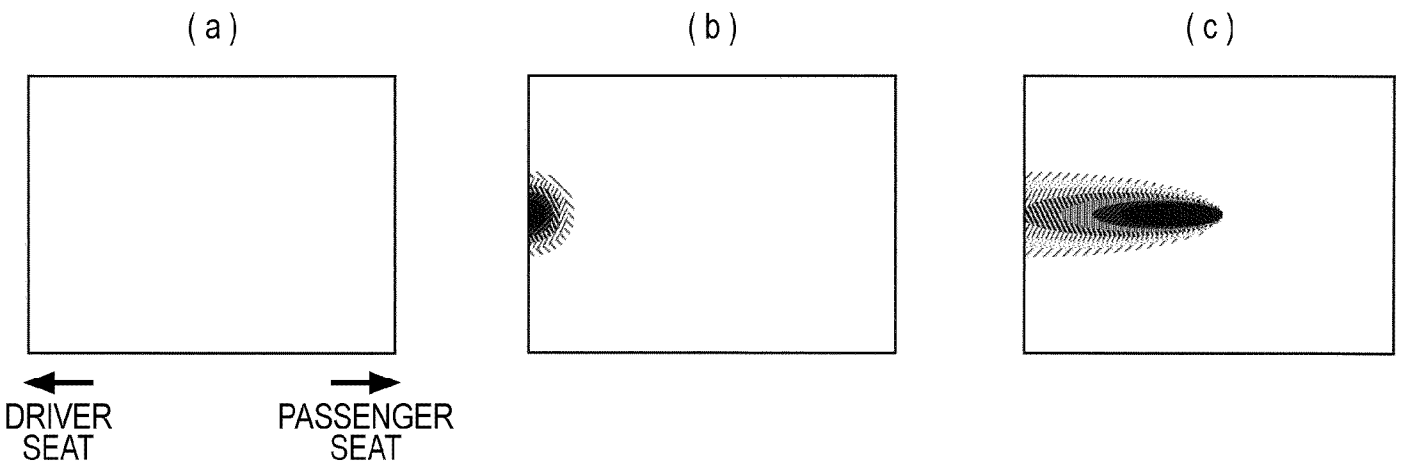
FIG. 7B is a diagram showing the process for determination of operation on the display device.

The principle on which the operation on the display panel 100 is detected by this sensor system 130 will be described. FIG. 6 shows approaches of the operator's finger, expressed by a sphere, as viewed from above the display panel 100. FIGS. 7A and 7B show changes in the quantity of light with approach.

As shown in FIG. 6, a finger of the operator sitting in the driver seat may approach the display panel 100 through points (a), (b), and (c) under relatively light outside conditions. In this case, the light that enters the sensor systems 130 of pixels L may be expressed as distribution charts (a), (b), and (c) of FIG. 7A. That is, the area of the portion with a small quantity of light may be reduced because the area of projection of the finger gradually decreases as the finger approaches the display panel 100. Here the stroke of the projection center of the finger may be small, because the finger approaches from the driver seat.

In contrast, the light that enters the sensor systems 130 of pixels R may be expressed as distribution charts (a), (b), and (c) of FIG. 7B. Specifically, for a finger at point (a) far from the display panel 100, the quantity of light that may enter the sensor system 130 of pixels R through the light-shielding members 150 does not change. When the finger reaches point (b), the projection of the finger overlaps with the periphery of the display panel 100 adjacent to the driver seat, so that part of the periphery decreases in light quantity. As the finger approaches point (c), the elliptical projection of the finger moves.

When the finger comes into almost contact with the display panel 100, the parallax between the pixels L and the pixels R becomes almost zero, thus causing overlap between the projection detected in the sensor systems 130 of pixels L and the projection detected in the sensor systems 130 of pixels R.

On the other hand, when a finger of the operator sitting in the passenger seat approaches the display panel 100, the relationship between the pixels L and the pixels R is reversed.

Under relatively dark outside conditions such as at night or in a tunnel, light emitted from the backlight (not shown) is reflected by the finger and sensed by the sensor system 130, so the quantity of light increases conversely as the finger approaches, so that the direction of change of the quantity of light is reversed. However, increases in the area of the portion whose quantity of light changes and shifts of the center of gravity may be the same as those of FIGS. 6 and 7. Accordingly, for example, as a finger of the operator sitting in the driver seat approaches the display panel 100, the area of a small (or large) quantity of light decreases and the shift of the center of gravity thereof is smaller than the amount of approach in the distribution chart of the light incident on the sensor systems 130 of pixels L.

The portion with a small or large quantity of light is herein referred to as a light-quantity changed portion for the sake of convenience.

The detection mode may be switched according to external environment. For example, the detection result may be reversed between a light ambient condition and a dark ambient condition.

Thus, when the distribution of light incident on the sensor systems 130 of pixels R or pixels L changes with time and when the area of the light-quantity changed portion has decreased, with the shift of the center of gravity thereof being small, it can be determined the operation is from the direction corresponding to the pixels at which the changes in quantity of light occurred. Furthermore, when the projection detected by the sensor systems 130 of pixels L and the projection detected by the sensor systems 130 of pixels R overlap and when the area of the overlapped portion has become smaller than a fixed value, it can be determined that a finger has touched the display panel 100.

Figure 5:
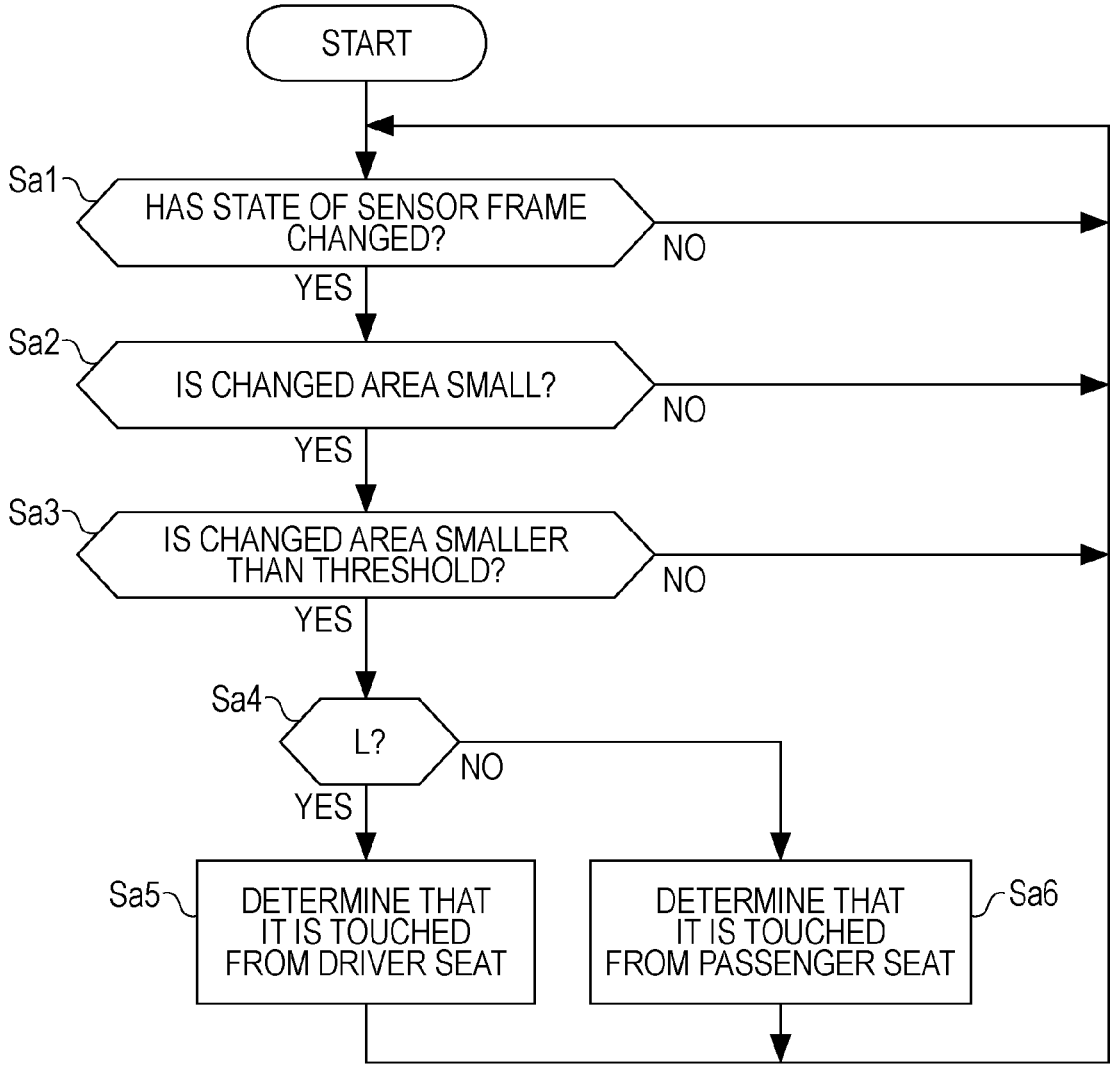
FIG. 5 is a flowchart for the process for determination of operation on the display device.

FIG. 5 is a flowchart showing a concrete procedure of this determination process.

After the determining circuit 20 obtains the results of detection of all the pixels of the sensor systems 130, it stores the detection results for comparison in step Sa1 of the next time, reads the results of detection obtained one sensor frame period before, and compares them with the detection results of this time to determine whether or not the shape of the portion with a small or large quantity of light (light-quantity changed portion) has changed in the sensor systems 130 of pixels L or pixels R. In the case where step Sa1 is executed for the first time, no detection result of one sensor frame period before is stored, so that the determination is executed after detection results of one sensor frame have been stored.

If it is determined that there is no change (No) the procedure returns to step Sa1, wherein the determining circuit 20 stands by for the next determination after a lapse of one sensor frame period. On the other hand, if it is determined that there is a change (Yes), the procedure moves to step Sa2.

The timing to execute step Sa1 is the time when the results of detection of the sensor systems 130 are obtained for all the pixels. Accordingly, step Sa1 of this embodiment is executed at the cycle of the sensor frame period.

In step Sa2, the determining circuit 20 determines whether the area of the light-quantity changed portion of the sensor systems 130 of pixels L or pixels R has decreased and whether the shift of the center of gravity of the light-quantity changed portion is within a threshold.

For example, when the finger approaches to the display panel 100 from the driver seat, the results of detection on the sensor systems 130 of pixels L shows that the area of the light-quantity changed portion is reduced; in contrast, the results of detection on the sensor systems 130 of pixels R shows that the area of the light-quantity changed portion is increased. However, in this case, the shift of the center of gravity of the light-quantity changed portion sensed from the sensor systems 130 of pixels L is small.

Thus, the determining circuit 20 can determine that the finger approaches to the display panel 100 from the driver seat from the results that the area of the light-quantity changed portion is reduced and that the shift of the center of gravity of the light-quantity changed portion is within a threshold. In the case where the finger approaches to the display panel 100 from the passenger seat, the relationship between pixels L and pixels R is reversed. However, the reduction in the area of the light-quantity changed portion and the small shift of the center of gravity are the same.

If the determination in step Sa2 is "No", the procedure returns to step Sa1.

If the determination in step Sa2 is "Yes", then the determining circuit 20 determines whether the outside diameter of the light-quantity changed portion has become smaller than a threshold (step Sa3). For example, in the case where the finger approaches to the display panel 100 from the driver seat, if the outside diameter of the light-quantity changed portion is larger than a threshold the results of detection on the sensor systems 130 of pixels L show that the finger approaches the display panel 100 but is far from the display panel 100 to some extent. In this state, the determination of step Sa3 is "No", and the procedure returns to step Sa1.

In contrast, the determination in step Sa3 is "Yes", the determining circuit 20 determines whether or not the reduction in the area of the light-quantity changed portion and the shift of the center of gravity smaller than a threshold have occurred in the sensor systems 130 of pixels L (step Sa4).

If the determination in step Sa4 is "Yes", then the determining circuit 20 determines that the person sitting in the driver seat has touched the display panel 100 with a finger (step Sa5); if the determination is "No", then the determining circuit 20 determines that the person sitting in the passenger seat has touched the display panel 100 (step Sa6). After the determination in step Sa5 or Sa6, the determining circuit 20 sends the determination to a higher-level control circuit of the car navigation system. Thus, a process corresponding to the touch operation is executed.

Examples of the process corresponding to the touch operation are switching the display screen in the direction of the touch operation and controlling the video or radio.

After the process of step Sa5 or Sa6, the procedure returns to step Sa1, where the determining circuit 20 stands by for the next determination after a lapse of a sensor frame period. Every time the results of determination on all the pixels of the sensor systems 130 are obtained, the determining circuit 20 repeats the process of steps Sa1 to Sa6.

If the person sitting in the driver seat or the passenger seat moves a finger or the like toward the display panel 100, both of the determinations in steps Sa1 and Sa2 result in "Yes". If the finger or the like comes into almost contact with the display panel 100, the determination in step Sa3 results in "Yes", and a determination is made whether or not the approach is from the driver seat (step Sa4).

If there is no action, the determination in step Sa1 results in "No"; if there is an action but it is not an approach to the display panel 100, the determination in step Sa2 results in "No. If there is an approach but a finger or the like has not come to almost contact with the display panel 100, the determination in step Sa3 results in "No".

Thus, this embodiment allows direct determination on the direction of approach of the finger or the like from the temporal changes of the light-quantity changed portion of the sensor systems 130 of pixels L or pixels R. Therefore, even if icons are displayed on substantially the same position on the display screen by pixels L for the driver seat and the display screen by pixels R for the passenger seat, this embodiment allows determination whether the touch operation is made from the driver seat or the passenger seat.

Application and Modification of First Embodiment

In the case where a finger or the like approaches from the driver seat, for example, the procedure of the flowchart of FIG. 5 does not give consideration to changes of the light-quantity changed portion of the sensor systems 130 of pixels R. However, as described with reference to FIGS. 6 and 7, in the state in which a finger or the like approaches from the driver seat or the passenger seat so that the centers of gravity of the light-quantity changed portions of the sensor systems 130 of pixels L and pixels R agree with each other and the finger comes into contact with the display panel 100, effects of parallax due to the light-shielding members 150 are eliminated. Accordingly, the shapes and the centers of gravity of the light-quantity changed portions of the sensor systems 130 of pixels L and pixels R agree substantially.

Thus, the touch operation should be determined by comparing the shapes and the centers of gravity of the light-quantity changed portions of the sensor systems 130 of pixels L and pixels R.

Figure 8:
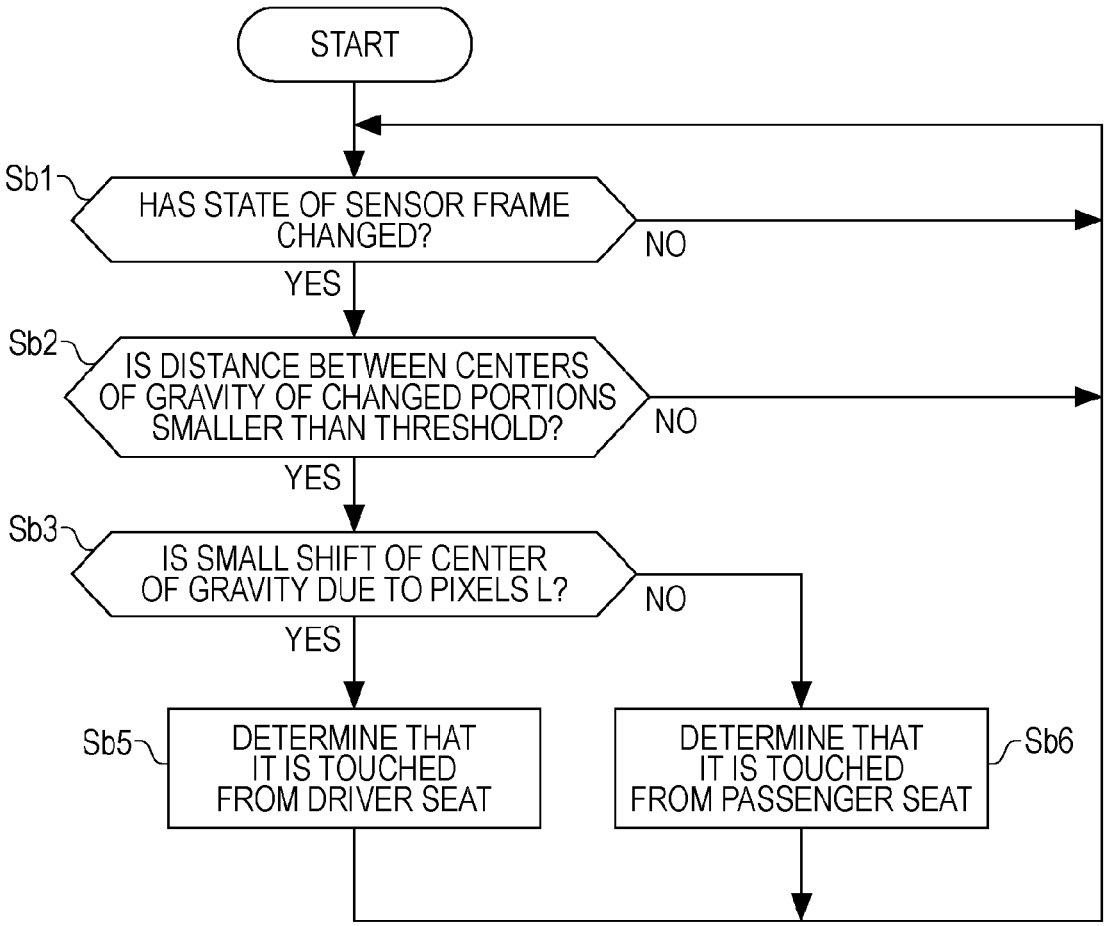
FIG. 8 is a flowchart for the process for determination of operation on the display device according to the first embodiment.

FIG. 8 is a flowchart for the procedure of determining the approach and the touch operation. Steps Sb1, Sb5, and Sb6 of this flowchart are the same as steps Sa1, Sa5, and Sa6 of FIG. 5, respectively.

After the determining circuit 20 obtains the results of detection of all the pixels of the sensor systems 130, it compares the detection results with the results of detection obtained one sensor frame period before to determine whether or not the shape of the light-quantity changed portion has changed in the sensor systems 130 of pixels L or pixels R. If it is determined that there is no change (No), the procedure returns to step Sb1. On the other hand, if it is determined that there is a change (Yes), the procedure moves to step Sb2, wherein the determining circuit 20 finds the centers of gravities of the light-quantity changed portions of the sensor systems 130 of pixels L and pixels R, and determines whether or not the distance between them is within a threshold.

If the distance is not within the threshold (No) the procedure returns to step Sb1; if the distance is within the threshold (Yes), the determining circuit 20 determines whether or not the shift of the center of gravity of the light-quantity changed portion in the sensor systems 130 of pixels L is smaller than that of the pixels R.

If the determination in step Sb3 is "Yes", then the determining circuit 20 determines that the person sitting in the driver seat has touched the display panel 100 with a finger (step Sb5); if the determination is "No", then the determining circuit 20 determines that the person sitting in the passenger seat has touched the display panel 100 (step Sb6). After the determination in step Sb5 or Sb6, the procedure returns to step Sb1, where the determining circuit 20 stands by for the next determination after a lapse of one sensor frame period.

This method also allows determination whether the touch operation is made from the driver seat or the passenger seat.

Second Embodiment

A display device according to a second embodiment of the invention will next be described.

Figure 9:
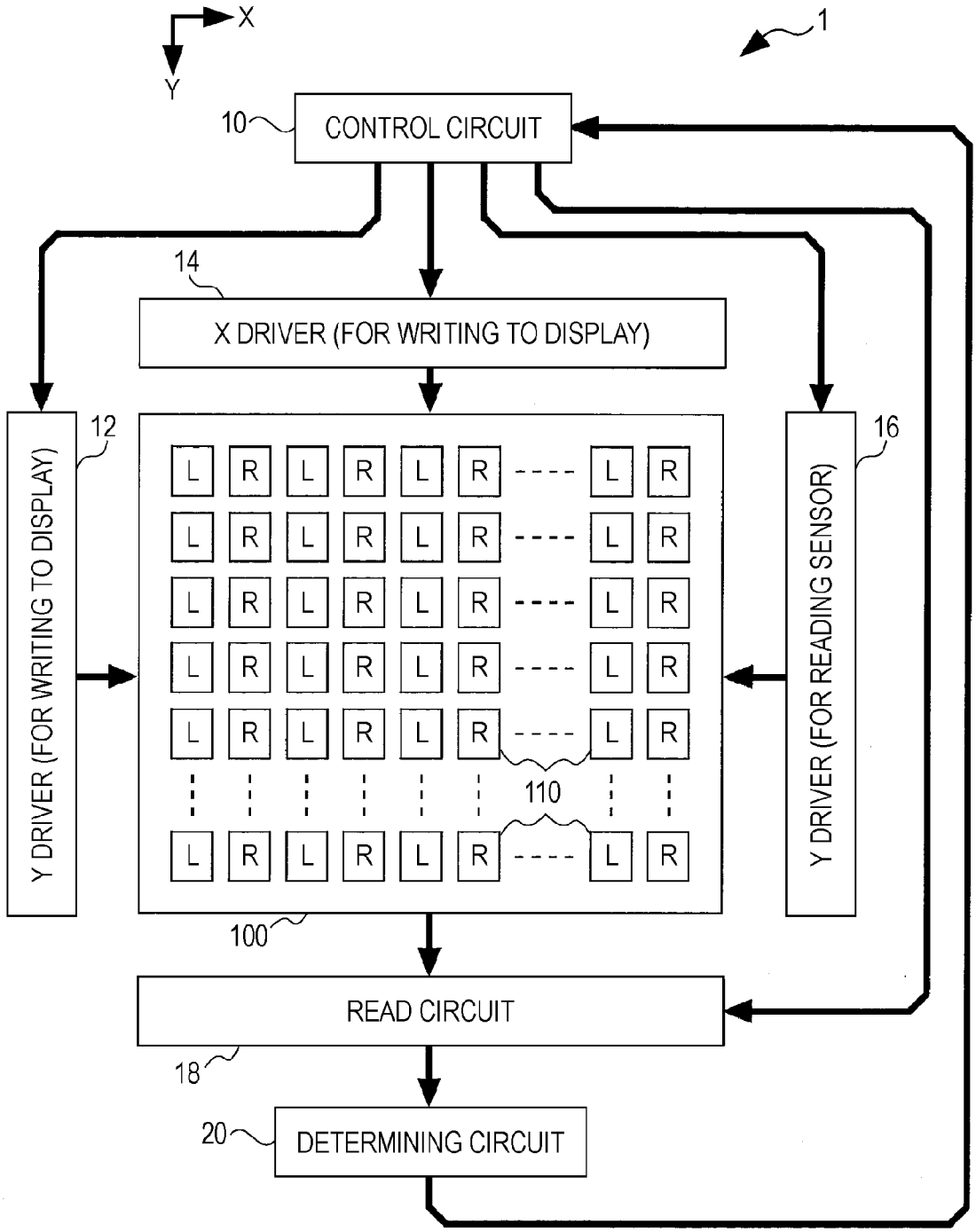
FIG. 9 is a diagram showing the structure of a display device according to a second embodiment.

FIG. 9 shows the structure of a display device 1 according to the second embodiment. The display device 1 of the second embodiment is the display of a car navigation system, as in the first embodiment. The difference from the first embodiment is that the determination by the determining circuit 20 is fed back to the control circuit 10, with which the control circuit 10 controls the Y driver 16 for driving the sensor systems 130 and the read circuit 18. The second embodiment will therefore be described mainly on the difference, that is, the control process.

Figure 11:
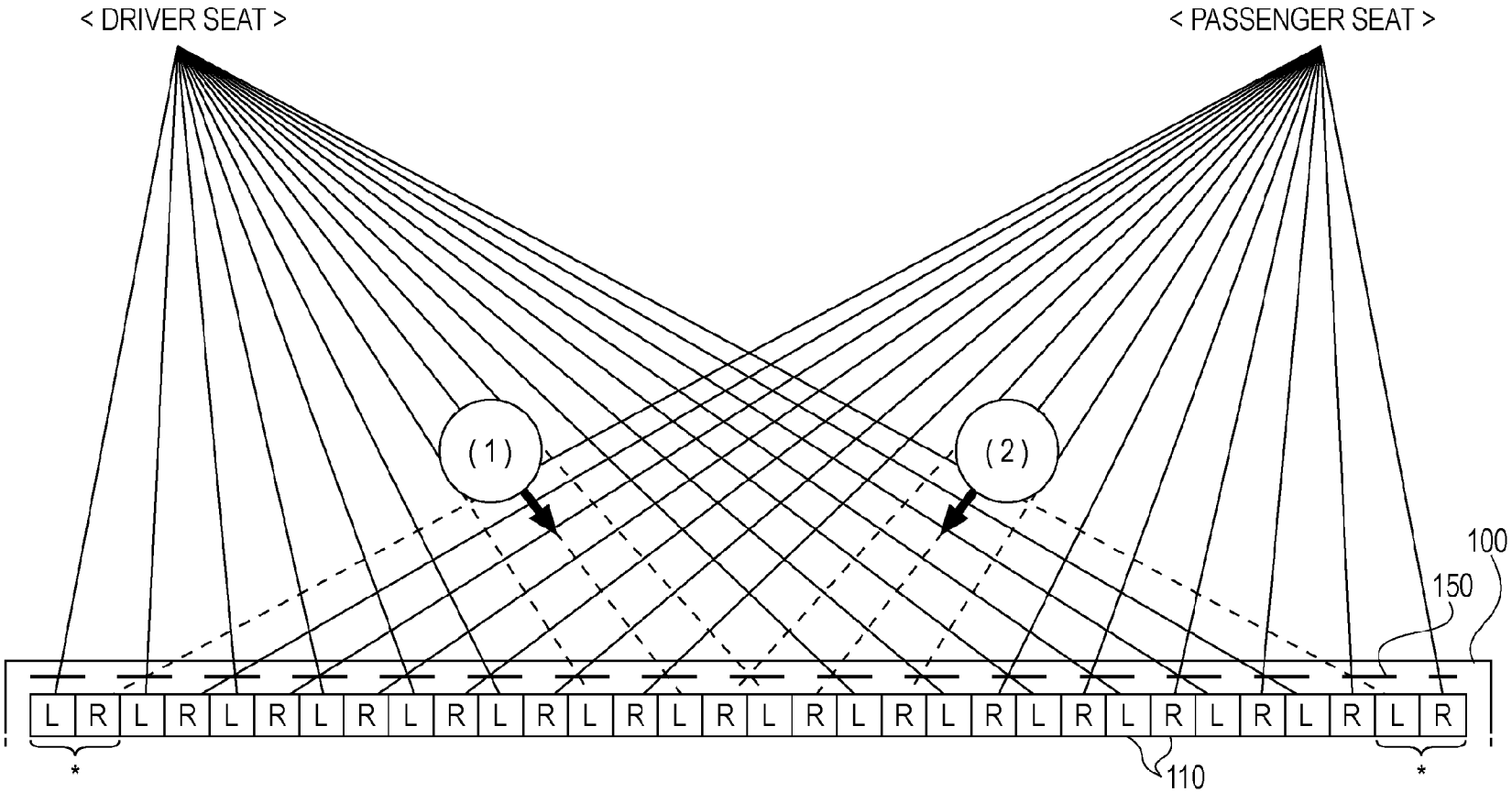
FIG. 11 is a diagram showing the process for determination of operation on the display device.

Referring to FIG. 11, for example, when a finger of the operator sitting in the driver seat has reached point (1) halfway to the display panel 100, light incident on the part of the passenger-seat-side pixels R closest to the driver seat is blocked by the finger. In contrast, when a finger of the operator sitting in the passenger seat has reached point (2) halfway to the display panel 100, light incident on the part of the driver-seat-side pixels L closest to the passenger seat is blocked by the finger.

In other words, when a finger or the like approaches from one of the driver seat and the passenger seat, the outermost part of the sensor systems of the other of the driver seat side and the passenger seat side changes in light quantity.

This eliminates the need for using all the sensor systems 130 for detection, allowing only the outermost sensor systems 130 on the outermost vertical two sides of the matrix array, or more specifically, only the pixels L and pixels R indicated by symbol * in FIG. 11. Thus, when one of the sensor systems 130 of pixels L and pixels R changes in light quantity, the other of the sensor systems 130 is operated to detect the touch operation, so that the power to be consumed by the operation of the sensor systems 130 can be reduced.

Figure 10:
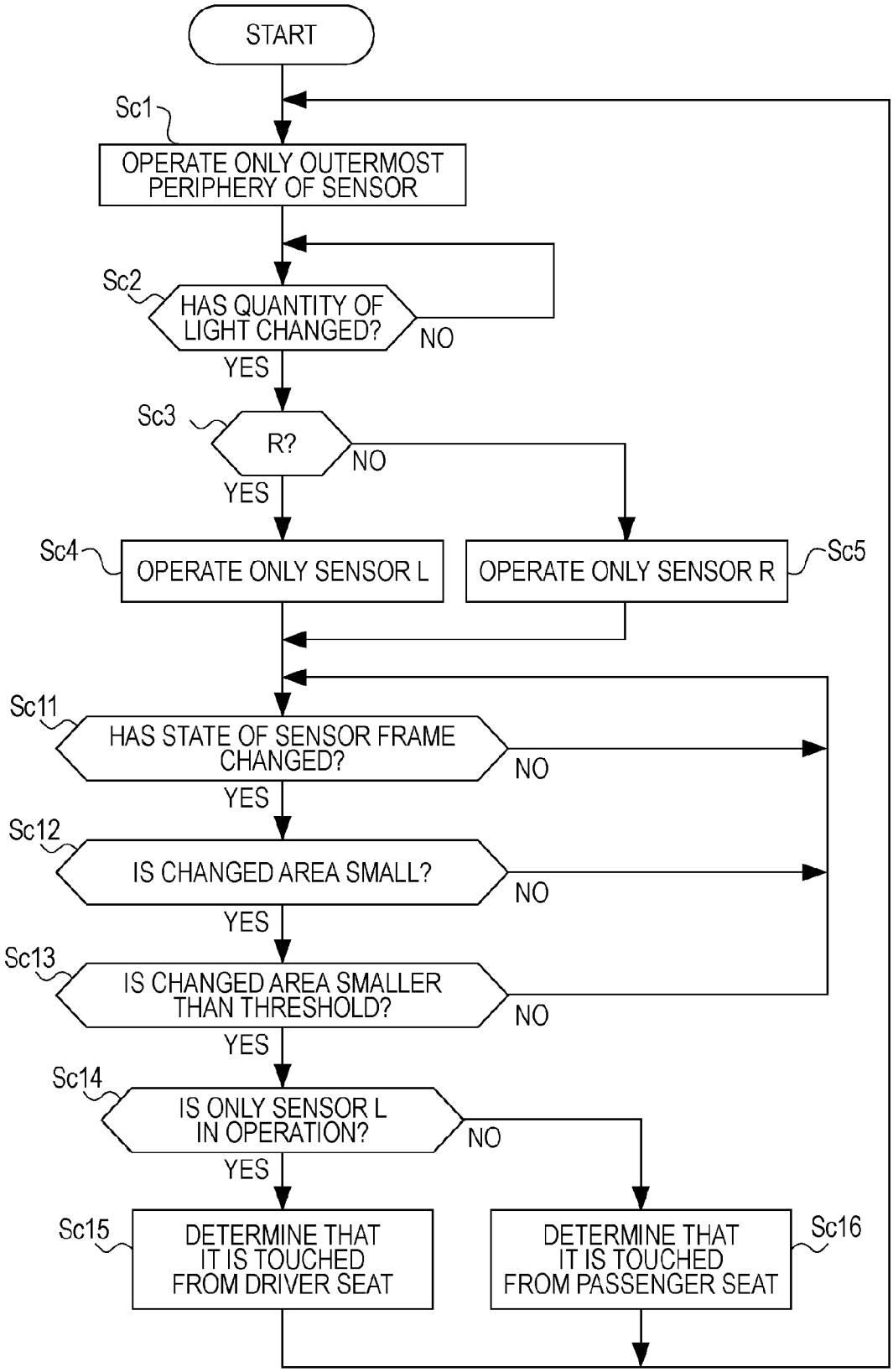
FIG. 10 is a flowchart for the process for determination of operation on the display device.

FIG. 10 is a flowchart showing a concrete procedure of this process.

First in step Sc1, the determining circuit 20 instructs the control circuit 10 to operate only the pixels L and pixels R of the sensor systems 130 on the outermost vertical two sides of the matrix array. Accordingly, the control circuit 10 controls the read circuit 18 so that it operates only four columns of read lines 144 in total including the left two columns and the right two columns and does not operate the other read lines 144, without changing the control on the Y driver 16.

Next, after obtaining the results of detection on the sensor systems 130 of pixels L and pixels R on the outermost vertical two sides, the determining circuit 20 compares the results with those obtained one sensor frame period before to determine whether a light-quantity changed portion has occurred in either of the sensor systems 130.

If it is determined that there is no change (No) the procedure returns to step Sc2, wherein the determining circuit 20 stands by for the next determination after a lapse of one sensor frame period. Thus, as long as the result of determination in step Sc2 is "No", only the pixels L and pixels R on the outermost vertical two sides of the matrix array are operated in the sensor systems 130.

On the other hand, if it is determined that there is a change (Yes), the procedure moves to step Sc3, wherein the determining circuit 20 determines whether the light-quantity changed portion has occurred in the sensor systems 130 of pixels R.

If the determination is "Yes", which indicates that this approach is from the driver seat, then the determining circuit 20 instructs the control circuit 10 to operate only the sensor systems 130 of pixels L (step Sc4). Thus, the control circuit 10 controls the read circuit 18 so that it operates only the read lines 144 of the columns of pixels L and does not operate the read lines 144 of the columns of pixels R.

On the other hand, if the determination in step Sc3 is "No", which indicates that the light-quantity changed portion is generated in the sensor systems 130 of pixels L, indicating the approach is from the passenger seat, the determining circuit 20 instructs the control circuit 10 to operate only the sensor systems 130 of pixels R (step Sc5). Thus, the control circuit 10 controls the read circuit 18 so that it operates only the read lines 144 of the columns of pixels R and does operate the read lines 144 of the columns of pixels L.

After the determining circuit 20 has obtained all the results of detection on the sensor systems 130 of pixels L or pixels R after step Sc4 or Sc5, the determining circuit 20 compares, in step Sc11, the results with those obtained one sensor frame period before to determine whether or not the shape of the light-quantity changed portion has changed. In the case where step Sc11 is executed for the first time, there is no stored detection result of one sensor frame period before, so that the determination is executed after detection results of one sensor frame have been stored.

If it is determined in step Sc11 that there is no change (No), the procedure returns to step Sc11, wherein the determining circuit 20 stands by for the next determination after a lapse of one sensor frame period. On the other hand, if it is determined that there is a change (Yes), the determining circuit 20 determines in step Sc12 whether the change is a decrease in the area of the light-quantity changed portion and whether the shift of the center of gravity of the light-quantity changed portion is within a threshold.

If the determination is "No", the procedure returns to step Sc11; on the other hand, if the determination is "Yes", then the determining circuit 20 determines whether the outside diameter of the light-quantity changed portion is smaller than a threshold (step Sc13).

If the determination in step Sc13 is "No", the procedure returns to step Sc11; on the other hand, if the determination is "Yes", the determining circuit 20 determines whether the change occurs in the pixels L of the sensor systems 130 in operation (step Sc14). If the determination in step Sc14 is "Yes", then the determining circuit 20 determines that the person sitting in the driver seat has touched the display panel 100 with a finger (step Sc15); if the determination is "No", then the determining circuit 20 determines that the person sitting in the passenger seat has touched the display panel 100 (step Sc16).

After step Sc15 or Sc16, the procedure returns to step Sc1, and the processes of steps Sc1 to Sc5 and Sc11 to Sc16 are repeated.

In this embodiment, in the initial state of detection, only the sensor systems 130 of pixels L and pixels R on the outermost vertical two sides of the matrix array are operated. When the person sitting in the driver seat or the passenger seat moves a finger or the like toward the display panel 100, only all of one of the pixels L and pixels R corresponding to the direction of approach are operated according to the determinations in step Sc2 and Sc3. Accordingly, in this embodiment, only the sensor systems 130 of pixels L and pixels R on the outermost vertical two sides have to be operated as long as the determination in step Sc2 is "No". Even if the determination in step Sc2 turns to "Yes", only one of the sensor systems 130 of Pixels L and pixels R has to be operated, so that the power required to operate the sensor systems 130 can be reduced.

Third Embodiment

Although the first and second embodiments are configured to detect the direction of approach of a finger or the like for the driver seat side and the passenger seat side, the third embodiment is configured to detect an approach from the rear seat (central rear seat).

Since the structure of the third embodiment is the same as that of the first embodiment (see FIG. 1), the description is concentrated to the principle and procedure of detection.

Figure 13:
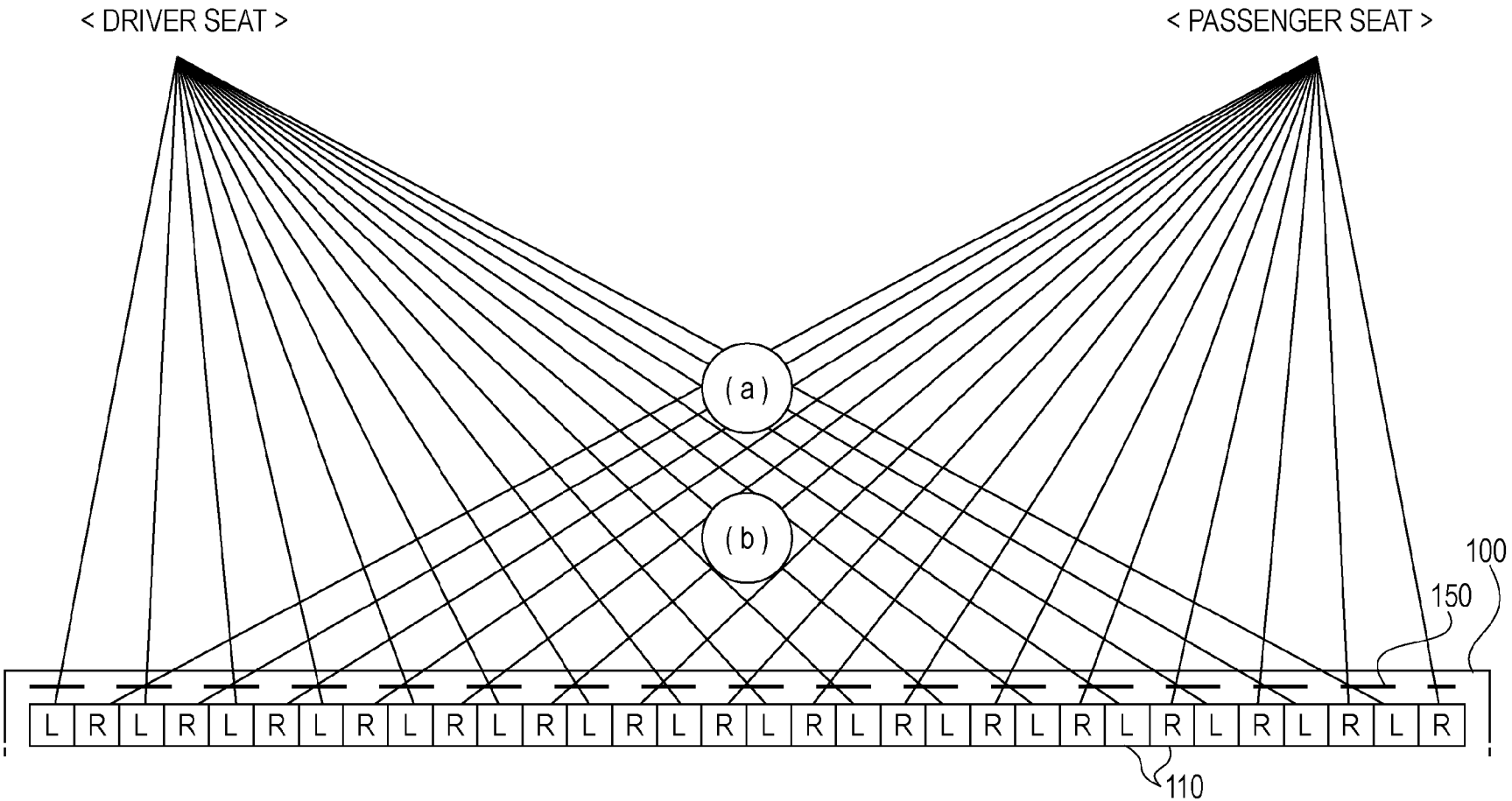
FIG. 13 is a diagram showing the process for determination of operation on the display device.

As shown in FIG. 13, when a finger of the operator sitting in the rear seat approaches from the front of the display panel 100, the finger may pass through points (a) and (b).

Figure 14A:
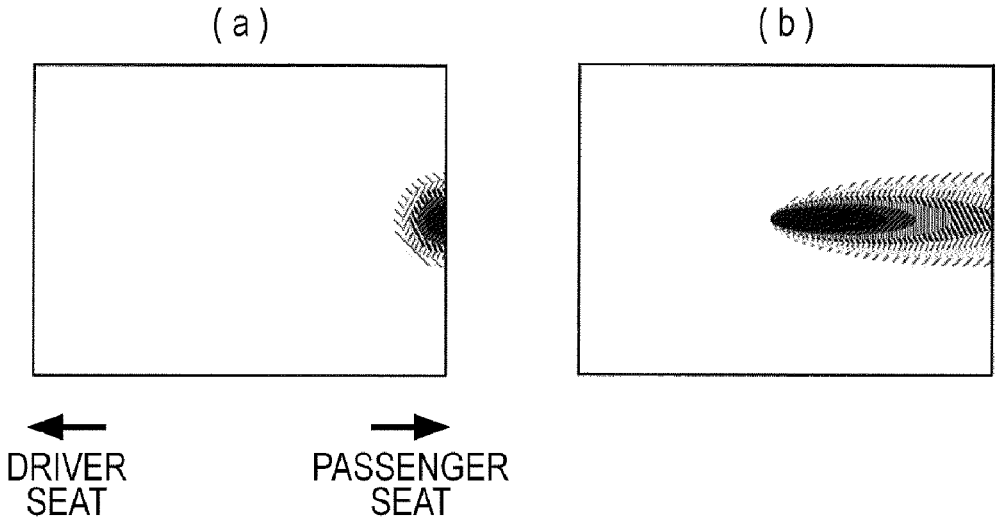
FIG. 14A is a diagram showing the process for determination of operation on the display device.
Figure 14B:
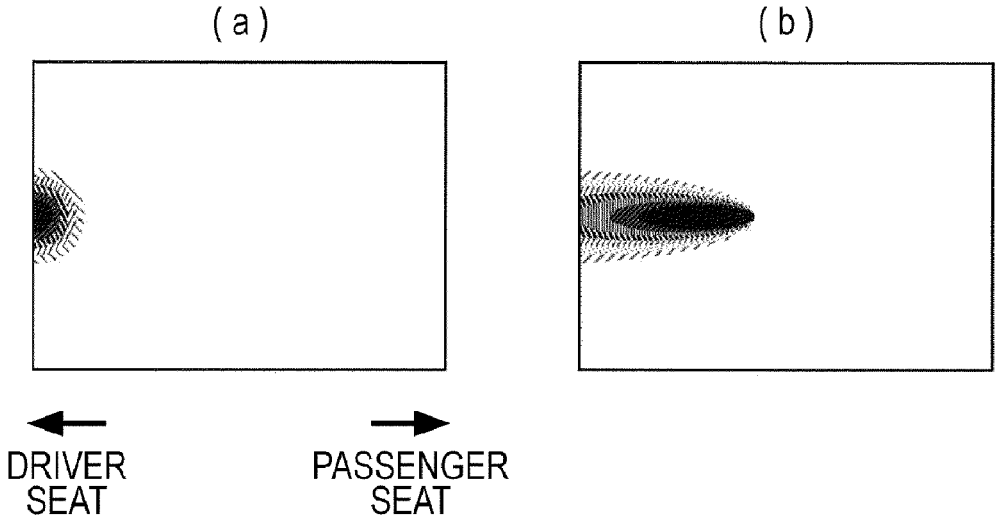
FIG. 14B is a diagram showing the process for determination of operation on the display device.

When the finger reaches point (a), for the sensor systems 130 of pixels L, the pixels L adjacent to the passenger seat change in light quantity, as shown in (a) of FIG. 14A; for the sensor systems 130 of pixels R, the pixels R adjacent to the driver seat change in light quantity, as shown in (a) of FIG. 14B.

When the finger reaches point (b), for the sensor systems 130 of pixels L, the center of the elliptical projection of the finger moves toward the portion to be touched in the direction of the driver seat, as shown in (b) of FIG. 14A; in contrast, for the sensor systems 130 of pixels R, the center of the elliptical projection of the finger moves toward the portion to be touched in the direction of the passenger seat, as shown in (b) of FIG. 14B.

Accordingly, in the case of touch operation from the rear seat, the light-quantity changed portions detected by the sensor systems 130 of pixels L and pixels R become substantially symmetrical about the portion to be touched. Thus, the determining circuit 20 can determine that the touch operation is from the rear seat by detecting that the light-quantity changed portions are symmetrical.

Figure 12:
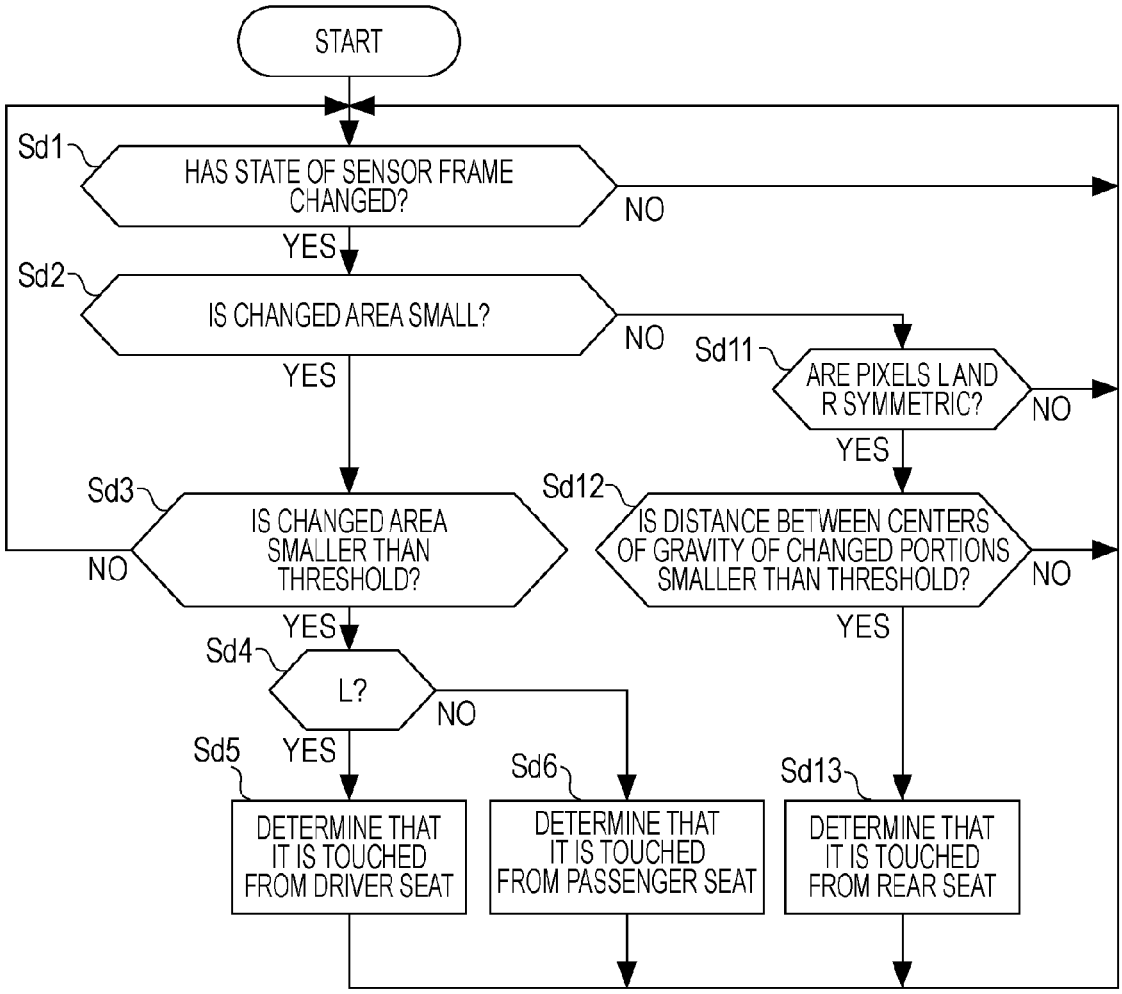
FIG. 12 is a flowchart for the process for determination of operation on a display device according to a third embodiment.

FIG. 12 is a flowchart showing a concrete procedure of this process.

After obtaining the results of detection of all the pixels of the sensor system 130, in step Sd1, the determining circuit 20 compares them with the detection results obtained one sensor frame period before to determine whether or not the shape of the light-quantity changed portion has changed in the sensor system 130 of pixels L or pixels R.

If it is determined that there is no change (No) the procedure returns to step Sd1, wherein the determining circuit 20 stands by for the next determination after a lapse of one sensor frame period. On the other hand, if it is determined that there is a change (Yes), the determining circuit 20 determines in step Sd2 whether the area of the light-quantity changed portion of the sensor system 130 of pixels L or pixels R has reduced and whether the shift of the center of gravity of the light-quantity changed portion is within a threshold.

If the determination in step Sd2 is "Yes", the determining circuit 20 executes the process of steps Sd3 to Sd6 similar to step Sc3 to Sc6 of the first embodiment to determine whether the touch operation is from the driver seat or the passenger seat.

If the determination in step Sd2 is "No", the determining circuit 20 determines in step Sd11 whether the light-quantity changed portions by the sensor systems 130 of the pixels L and pixels R are in symmetry.

If the determination is "No", the procedure returns to step Sd1; if the determination is "Yes", the determining circuit 20 finds the centers of gravities of the light-quantity changed portions by the sensor systems 130 of pixels L and pixels R, and determines whether the distance between the centers is within a threshold (step Sd12). If the distance is not within the threshold (No), the procedure returns to step Sd1. If the distance is within the threshold (Yes), the determining circuit 20 determines in step Sd13 that the approach of the finger or the like is from the rear seat and that the finger or the like has touched the display panel 100, and sends the determination to the control circuit 10 or a higher-level control circuit of the car navigation system.

The control circuit 10 of the third embodiment controls the screen as follows in response to the touch operation:

The control circuit 10 controls the display of the display panel 100 in such a manner that if only a touch operation from the driver seat is detected and no touch operation from the passenger seat or the rear seat is detected for a fixed period, the display is put into a one-screen mode in which only the screen for the driver seat is displayed and if a touch operation from the driver seat or the rear seat is added for a fixed period, the display is put into a two-screen mode in which both the screen for the driver seat and the screen for the passenger seat are displayed.

Another example of screen control is that described in the first embodiment.

After the process of steps Sd5 and Sd6 or step Sd13, the procedure returns to step Sd1, wherein the determining circuit 20 stands by for the next determination after a lapse of one sensor frame period.

In this way, the third embodiment allows direct determination whether a finger touch operation is made from the rear seat, in addition to those from the driver seat and the passenger seat.

Although the above embodiments are configured to determine that a touch operation is made when a finger or the like has touched the display panel 100, the determination may be made when it has reached close proximity to some extent, and in other words, it has approached from any direction.

Although the above embodiments describe the display panel 100 as a liquid crystal display, other display devices such as an organic electroluminescence display device and a plasma display device that combine the sensor systems 130 in the pixels can also detect an approaching direction and touch operation.

In addition to the car navigation system described above, examples of electronic devices incorporating the display device include devices that require touch operation such as portable phones, digital still cameras, televisions, viewfinder or monitor-direct-view type videotape recorders, pagers, electronic notebooks, calculators, word processors, workstations, TV phones, and POS terminals.

The entire disclosure of Japanese Patent Application No. 2007-110454, filed Apr. 19, 2007 is expressly incorporated by reference herein.

What is claimed is:

1. A method for controlling a determining apparatus including first pixels for displaying a first image, second pixels for displaying a second image, a light shielding member that allows the first image to be viewed from a first direction and blocks the first image from a second direction, and allows the second image to be viewed from the second direction and blocks the second image from the first direction, a first sensor provided for at least one of the first pixels and detecting the quantity of light coming from the first direction, and a second sensor provided for at least one of the second pixels and detecting the quantity of light coming from the second direction, wherein the light shielding member allows light to approach the first sensor from the first direction and blocks light from approaching the first sensor from the second direction, and wherein the light shielding member allows light to approach the second sensor from the second direction and blocks light from approaching the second sensor from the first direction, the method comprising:

obtaining a first detection result of the first sensor and a second detection result of the second sensor during a first time;

obtaining a third detection result of the first sensor and a fourth detection result of the second sensor during a second time after the first time;

obtaining a first result by comparing the third detection result with the first detection result;

obtaining a second result by comparing the fourth detection result with the second detection result; and determining whether an object is approaching from the first direction or from the second direction based on the first result and the second result.

2. The method according to claim 1, in the step of obtaining the first result, determining a shrinkage ratio in quantity of light detected by the first sensor between the first detection result and the third detection result, in the step of obtaining the second result, determining a shrinkage ratio in quantity of light detected by the second sensor between the second detection result and the fourth detection result, and in the step of determining, comparing the first result and the second result to determine whether a shrinkage ratio is greater for the first sensor or for the second sensor, determining that an object is approaching from the first direction when the shrinkage ratio is greater for the first sensor than for the second sensor, and determining that an object is approaching from the second direction when the shrinkage ratio is greater for the second sensor than for the first sensor.

3. The method according to claim 1, in the step of obtaining the first result, determining a shift amount of gravity center in quantity of light detected by the first sensor between the first detection result and the third detection result, in the step of obtaining the second result, determining a shift amount of gravity center in quantity of light detected by the second sensor between the second detection result and the fourth detection result, and in the step of determining, comparing the first result and the second result to determine whether a shift amount of gravity center is greater for the first sensor or for the second sensor, determining that an object is approaching from the first direction when the shift amount is smaller for the first sensor than for the second sensor, and determining that an object is approaching from the second direction when the shift amount is smaller for the second sensor than for the first sensor.

4. The method according to claim 1, in the step of determining by comparing the first result and the second result, determining that an object is approaching from the center between the first direction and the second direction when the shift in quantity of light detected by the first sensor between the first detection result and the third detection result being symmetrical to the shift in quantity of light detected by the second sensor between the second detection result and the fourth detection result.

5. A method for controlling a display device, comprising controlling a determining apparatus by the method of controlling the determining apparatus according to claim 1; and controlling the first image and/or the second image according to an approaching direction determined from the results of detection.

6. A method for controlling a determining apparatus including first pixels for displaying a first image, second pixels for displaying a second image, a light shielding member that allows the first image to be viewed from a first direction and blocks the first image from a second direction, and allows the second image to be viewed from the second direction and blocks the second image from the first direction, first sensors provided for the first pixels, the first sensors being detecting the quantity of light coming from the first direction and including a third sensor that is provided adjacent to the first direction and a fourth sensor that is provided adjacent to the second direction, and second sensors provided for the second pixels, the second sensors being detecting the quantity of light coming from the second direction and including a fifth sensor that is provided adjacent to the first direction and a sixth sensor that is provided adjacent to the second direction, the first and second sensors being arranged in a matrix matter, wherein the light shielding member allows light to approach the first sensors from the first direction and blocks light from approaching the first sensor from the second direction, and wherein the light shielding member allows light to approach the second sensors from the second direction and blocks light from approaching the second sensor from the first direction, the method comprising:

obtaining a first detection result of the fourth sensor and a second detection result of the fifth sensor during a first time;

obtaining a third detection result of the fourth sensor and a fourth detection result of the fifth sensor during a second time after the first time; and in the case that there is a difference between the second detection result and the fourth detection result, determining that an object is approaching from the first direction, and in the case that there is a difference between the first detection result and the third detection result, determining that an object is approaching from the second direction.

7. The method for controlling the determining apparatus according to claim 6, in the case that there is a difference between the second detection result and the fourth detection result, detecting the quantity of light by using the first sensors, and in the case that there is a difference between the first detection result and the third detection result, detecting the quantity of light by using the second sensors.

8. A method for controlling a determining apparatus including a first pixel section for displaying a first image, a second pixel section for displaying a second image, a light shielding member that allows the first image to be viewed from a first direction and blocks the first image from a second direction, and allows the second image to be viewed from the second direction and blocks the second image from the first direction, a first sensor provided for the first pixel section and detecting the quantity of light coming from the first direction, and a second sensor provided for the second pixel section and detecting the quantity of light coming from the second direction, wherein the light shielding member allows light to approach the first sensor from the first direction and blocks light from approaching the first sensor from the second direction, and wherein the light shielding member allows light to approach the second sensor from the second direction and blocks light from approaching the second sensor from the first direction, the method comprising:

storing at least one frame of the results of detection of the first and second sensors; and after obtaining the present results of detection of the first and second sensors, determining whether an object approaches from the first direction or the second direction from the result of comparison between the stored detection results of one frame and the results of detection of present one frame.

9. A determining apparatus comprising:

a first pixel for displaying a first image;

a second pixel for displaying a second image;

a light shielding member that allows the first image to be viewed from a first direction and blocks the first image from a second direction, and allows the second image to be viewed from the second direction and blocks the second image from the first direction;

a first sensor provided for the first pixel and detecting the quantity of light coming from the first direction;

a second sensor provided for the second pixel and detecting the quantity of light coming from the second direction; and a determining circuit that stores at least one frame of the results of detection of the first sensor and second sensor and determines whether an object approaches from the first direction or the second direction from the result of comparison between the stored detection results of one frame and the results of detection of present one frame, wherein the light shielding member allows light to approach the first sensor from the first direction and blocks light from approaching the first sensor from the second direction, and wherein the light shielding member allows light to approach the second sensor from the second direction and blocks light from approaching the second sensor from the first direction.

* * * * *